United States Patent [19]

Friedman et al.

[11] 4,007,006

[45] Feb. 8, 1977

[54] MODIFICATION OF WOOL

[75] Inventors: Mendel Friedman, Moraga; Nathan H. Koenig, Albany, both of Calif.

[73] Assignee: The United States of America as represented by the Secretary of Agriculture, Washington, D.C.

[22] Filed: Sept. 4, 1975

[21] Appl. No.: 610,473

[52] U.S. Cl. ..... 8/128 R
[51] Int. Cl.[2] ..... D06M 13/20
[58] Field of Search ..... 8/128 R

[56] References Cited

UNITED STATES PATENTS

| | | | |
|---|---|---|---|
| 2,986,445 | 5/1961 | Koenig | 8/128 R |
| 3,867,095 | 2/1975 | Koenig et al. | 8/128 R |

OTHER PUBLICATIONS

Textile Res. J., Wool Modification with Acid Anhydrides in Dimethylformamide, N. H. Koenig, vol. 35, II, pp. 706–715, Aug., 1965.

*Primary Examiner*—John Kight, III
*Attorney, Agent, or Firm*—M. Howard Silverstein; David G. McConnell; William Takacs

[57] ABSTRACT

Wool is modified by reacting it with a wool-modifying reagent (e.g., tetrabromophthalic anhydride) in the presence of a reaction promoter (e.g., dimethylformamide) and a low-boiling inert solvent (e.g., dichloromethane), at an ambient temperature of about 100° to 120° C., and in an open vessel to permit evaporation of the low-boiling solvent.

6 Claims, No Drawings

MODIFICATION OF WOOL

DESCRIPTION OF THE INVENTION

The invention relates to and has among its objects the provision of novel processes for preparing modified wool products which exhibit improved properties in such areas as flame resistance, shrink resistance, resistance to bleaching and other oxidizing conditions. Further objects of the invention will be evident from the following description wherein parts and percentages are by weight unless otherwise specified.

Wool may be modified to improve its properties in a number of ways. One general method for such modification involves reacting the wool with a wool-modifying reagent in the presence of a reaction promoter, as disclosed in a series of patents referred to below.

The wool-modifying reagent may be an organic acid anhydride (U.S. Pat. Nos. 2,986,445, 3,079,215, 3,097,052, and 3,332,733, and 3,346,327), an organic acid chloride (U.S. Pat. Nos. 2,993,748, 3,110,542, and 3,110,543), an organic isocyanate (U.S. Pat. Nos. 2,974,003, and 3,112,157 and 3,145,074), a haloketone (U.S. Pat. No. 3,055,727), a benzyl halide (U.S. Pat. No. 3,107,969), or an epoxide (U.S. Pat. No. 3,102,774).

The reaction promoter may be dimethylformamide (U.S. Pat. Nos. 2,974,003, 2,993,748, 2,986,445, 3,055,727, 3,107,969, and 3,102,774), dimethyl sulfoxide (U.S. Pat. No. 3,079,215), cresol (U.S. Pat. No. 3,332,733), methylpyrrolidone (U.S. Pat. Nos. 3,110,543 and 3,145,074), gamma-butyrolactone (U.S. Pat. Nos. 3,110,542, 3,112,157, and 3,346,327), or acetic acid (U.S. Pat. No. 3,097,052).

The general method described above is, however, costly because it requires that the reaction promoter be used in such quantity as to additionally function as the reaction solvent. Because of the low volatility of the reaction promoters they are not easily recovered from the reaction products. Also, methods for their recovery by means such as extraction are too costly to be practiced on a commercial scale.

Attempts have been made to employ an inert solvent as a diluent, thus to reduce the amount of the reaction promoter. These, however, have not met with success. Unfortunately, the inert solvent altered the reaction system in such a way that the modification of the wool was impeded. For example, in U.S. Pat. No. 2,986,445 it is disclosed that conventional inert solvents such as chlorobenzene, toluene, or butyl ether may be used, but it is cautioned that they reduce the reaction rate.

We have discovered a procedure which avoids the problem outlined above. In accordance with the invention an inert volatile solvent can be effectively used as a diluent in the modification of wool with a wool-modifying reagent in the presence of a reaction promoter.

One advantage of the invention is that it is less expensive than the known procedures. This is so because the reaction promoter need be provided only in the amount required to exert its function of promoting reaction between the wool and the wool-modifying reagent. This is in contrast to the known system where the promoter had to be added in such amount as to function both as reaction promoter and as reaction solvent. An economic advantage is gained in accordance with the invention because the inert volatile solvent used as the diluent is less expensive than the reaction promoter. In addition, it is within the compass of the invention to recover the inert volatile solvent, thereby reducing the cost even more.

A further advantage of the invention is that even distribution of the wool-modifying reagent on the wool is obtained. This is important because the trade demands textile products of uniform degree of modification on all areas of the textile.

It is further to be noted that the enhanced properties (flame-resistance, shrink-resistance, resistance to oxidizing agents, etc.) of the modified wool are retained despite laundering and dry cleaning of the products produced in accordance with the invention. The durability of the modification achieved by the invention is due to the fact that the modifying reagent becomes chemically bound to the wool.

Another valuable asset of the invention is that the modification does not impair the intrinsic properties of the wool. For example, the treatment does not impair the elasticity, hand, or tensile strength of the textile. The products of the invention are suitable for all the conventional uses of wool such as fabrication of carpeting, upholstery, drapery fabrics, garments, etc.

In a practice of the invention, wool is reacted with a wool-modifying reagent in the presence of a reaction promoter and an inert volatile solvent, using a technique described in detail below.

As the wool-modifying reagent one may use any of the compounds disclosed in the aforementioned patents, namely, an organic acid anhydride, including aliphatic, aromatic, and aromatic-aliphatic acid anhydrides (U.S. Pat. Nos. 2,986,445, 3,079,215, 3,097,052, 3,332,733, and 3,346,327); an organic acid chloride including aliphatic, aromatic, and aromatic-aliphatic acid chlorides (U.S. Pat. Nos. 2,993,748, 3,110,542, and 3,110,543); an organic isocyanate, including aromatic, aliphatic, and aromatic-aliphatic isocyanates (U.S. Pat. Nos. 2,974,003, 3,112,157 and 3,145,074); a haloketone (U.S. Pat. No. 3,055,727); a benzyl halide (U.S. Pat. No. 3,107,969); or an epoxide (U.S. Pat. No. 3,102,774). The disclosures of the said patents are incorporated herein by reference. The amount of wool-modifying reagent used may be varied depending on the degree of modification desired. Usually one uses about 0.1 to 0.5 part of the reagent per part of wool. In a preferred embodiment of the invention, tetrabromophthalic anhydride is used as the wool-modifying reagent, and has the advantage that the wool modified therewith has enhanced flame resistance.

As the reaction promoter, one may use dimethylformamide, dimethylsulphoxide, cresol, methylpyrrolidone, gamma-butyrolactone, or acetic acid. As noted hereinabove, a primary feature of the invention is that effective modification of wool can be achieved in a reaction system wherein the amount of reaction promoter is limited to provide only enough thereof to exhibit its reaction promoting effect. In many cases, this valuable advantage can be attained by using as little as about 0.25 to 0.5 part of the reaction promoter per part of wool.

As the inert volatile solvent one may use any inert solvent which has a boiling point in the range from about 30° to about 60° C. Examples of such solvents are dichloromethane, pentane, cyclopentane, neohexane, diethyl ether, methyl formate, ethyl formate, acetone, and petroleum ether or other petroleum distillate which boils in the 30°–60° C. range. The amount of inert solvent used is usually about 2 to 10 parts (by volume) per part (by weight) of wool. (It may be noted herein that a reference to parts by volume of one substance per part by weight of another is on a metric system, so that, for example, 5 parts by volume of solvent per part by weight of wool is the same as 5 ml. solvent per gram of wool.)

The method of carrying out the wool modification reaction is critical to the present invention. A mixture is prepared of the wool-modifying reagent and the reaction promoter in the inert volatile solvent. The wool to be treated is placed in this mixture. The reaction system (the wool and the mixture) is then exposed to an ambient temperature of about 100° to 120° C. under conditions which allow the inert solvent to be evaporated during the course of the reaction. This can be readily achieved by placing the reaction system in a vessel (which is completely open or at least unsealed so that vapors can escape therefrom) and placing the vessel in an oven maintained at about 100°–120° C. The evaporation of the inert volatile solvent from the reaction system has the important effect that it permits the temperature of the system to gradually attain that of the ambient, whereby the desired reaction between the wool and the wool-modifying reagent can take place rapidly and effectively.

The time of reaction is directly dependent on the temperature applied. At higher temperatures the reaction proceeds more rapidly and thus a shorter reaction time is involved. Generally, the time of reaction will vary from about 15 to 60 minutes. In commercial practice even shorter times are possible by ambient temperatures up to about 200° C., provided the wool is passed through the system fast enough to avoid damage to the fiber.

After the modification reaction has been completed, the product (the modified wool) is treated by conventional methods to remove unreacted reagents. Thus, the product may be treated as by wringing, passage through squeeze rolls, centrifugation, or the like to remove the excess materials. In place of such mechanical action, or following it, the product may be extracted with an inert volatile solvent such as trichloroethylene, carbon tetrachloride, benzene, toluene, butanone, acetone, alcohol, etc. Successive extractions with different solvents may be used to ensure complete removal of all unreacted materials. In a final step, the product is dried in a conventional manner.

It is within the compass of the invention and is indeed desirable to recover the inert solvent which is vaporized from the reaction system. This can be accomplished by techniques well known in the art, for example, cooling the vapors emanating from the reaction system to condense and recover the solvent.

EXAMPLES

The invention is further demonstrated by the following illustrative examples. Some of the experiments reported are not in accordance with the invention; they are provided for purpose of comparison.

EXAMPLE 1

Modification of Wool with Tetrabromophthalic Anhydride

A. A circular sample (8 cm. in diameter) was cut from undyed wool flannel. The fabric was scoured, extracted with trichloroethylene followed by ethanol, and then dried at 120° C. for 1 hour. A mixture was prepared in a Petri dish containing tetrabromophthalic anhydride (0.5 g.), dimethylformamide (0.5 ml., 0.47 g.), and dichloromethane (6 ml.). The dry fabric (1.2 g.) was placed in the mixture in the Petri dish which was covered but not sealed to allow escape of vapors. The Petri dish containing the reaction system was held for 30 minutes in an oven maintained at 120° C.

At the end of this time the modified wool was removed from the oven, cooled a few seconds, successively extracted with hot butanone and hot ethanol to remove unreacted reagents, and then dried. The increase in dry weight of the wool was determined. This increase is taken as a measure of the amount of tetrabromophthalic anhydride which chemically combined with the wool.

B. The procedure described in Part A was repeated with the following exception: The dry fabric and the mixture of tetrbromophthalic anhydride and dimethylformamide in dichloromethane were placed in a reaction vessel and heated under reflux (55° C.) for 30 minutes. In this way the dichloromethane was not allowed to escape from the reaction system but continuously returned thereto.

C. The procedure of Part A was repeated, except that the dimethylformamide was omitted.

D. The procedure of Part A was repeated, except that the dichloromethane was omitted.

The results obtained are summarized in the following table.

| Part | Tetrabromophthalic anhydride (g.) | Dimethylformamide (ml.) | Dichloromethane (ml.) | Temperature (° C.) | Time (min.) | Uptake (%) |
|---|---|---|---|---|---|---|
| A | 0.5 | 0.5 | 6.0 | 120 | 30 | 7 |
| B* | 0.5 | 0.5 | 6.0 | Reflux (55) | 30 | 2 |
| C* | 0.5 | 0 | 6.0 | 120 | 30 | 2 |
| D* | 0.5 | 0.5 | 0 | 120 | 30 | 6 |

*Not in accordance with the invention; provided for purpose of comparision.

It was also observed that the product of Part A exhibited uniform modification. By contrast, in the product of Part D the modification was not uniform. Parts of the sample were obviously unmodified, whereas other parts were stiff due to a high concentration of modification reagent in those areas.

EXAMPLE 2

The procedure of Example 1, Part A, was repeated except that 5 ml. petroleum ether (boiling range 30°–60° C.) was substituted for the dichloromethane. The modified wool product was found to have an uptake of 6%. It was also observed that this product was uniformly modified over its entire area.

EXAMPLE 3

An extracted and dried wool swatch (5 × 10 in., 7 g.) was placed in an enamelled tray containing tetrabromophthalic anhydride (3 g.) and dimethylformamide (3 ml., 2.8 g.) in 30 ml. of dichloromethane. The tray was covered, but not sealed, and held in an oven at 120° C. for 30 minutes. The modified wool was then removed, cooled, extracted in hot ethanol, then dried.

The modified wool was tested for flame resistance according to the AATCC 34-1969 procedure published in AATCC Technical Manual, Vol. 48, pages 201–202 (1972). Specimens (2.5 × 9.5 in.) were conditioned at 70° F., 65% R.H., and were exposed to a flame for 12 seconds. Treatment is considered effective when the average char length is less than 7 inches, and the after-flame persists less than 10 seconds on the average after removal of the source.

The results are summarized in the table below. For purposes of comparison an untreated wool sample was also tested for flame-resistance. The data show that wool modified in accordance with the invention has improved flame-resistance.

| Modifying agent | Uptake % | After-flame (sec.) | Char length (in.) |
|---|---|---|---|
| Tetrabromophthalic anhydride | 8.6 | 0 | 4.1 |
| None | 0 | 24 | Totally burned |

Having thus described the invention, what is claimed is:

1. A process for chemically modifying wool, which comprises a. providing a reaction system by immersing dry wool in a mixture containing a wool-modifying reagent, a reaction promoter, and an inert volatile solvent which has a boiling point of about 30° to 60° C., and b. exposing the reaction system to an ambient temperature of about 100° to 120° C. for about 15 to 60 minutes under conditions which permit evaporation of the inert volatile solvent during the course of the reaction, wherein the wool-modifying reagent is selected from the group consisting of organic acid anhydrides, organic acid chlorides, organic isocyanates, haloketones, benzyl halides, and epoxides, and wherein the reaction promoter is selected from the group consisting of dimethylformamide, dimethyl sulfoxide, cresol, methylpyrrolidone, gamma-butyrolactone, and acetic acid.

2. The process of claim 1 wherein the amount of reaction promoter is about 0.25 to 0.5 part per part of wool.

3. A process for chemically modifying wool, which comprises a. providing a reaction system by immersing dry wool in a mixture containing a wool-modifying reagent selected from the class consisting of aliphatic, aromatic, and aromatic-aliphatic acid anhydrides, dimethylformamide, and an inert volatile solvent which has a boiling point of about 30° to 60° C., b. placing the reaction system in an open vessel, and exposing the vessel and contents to an ambient temperature of about 100° to 120° C. for about 15 to 60 minutes.

4. The process of claim 3 wherein the amount of dimethylformamide is about 0.25 to 0.5 part per part of wool.

5. The process of claim 3 wherein the wool-modifying agent is tetrabromophthalic anhydride.

6. A process for chemically modifying wool, which consists of a. providing a reaction system consisting of 1 part of dry wool, about 0.4 to 0.5 part of tetrabromophthalic anhydride, about 0.25 to 0.5 part of dimethylformamide, and about 2 to 10 parts (by volume) of an inert volatile solvent which has a boiling point of about 30° to 60° C., b. placing the reaction system in a vessel which is open to permit evaporation of the inert volatile solvent during a subsequent heating step, and c. exposing the vessel and contents to an ambient temperature of about 120° C. at atmospheric pressure for a period of about 30 minutes.

* * * * *